United States Patent [19]

Holobaugh

[11] 4,216,991

[45] Aug. 12, 1980

[54] WALL PROXIMITY CHAIR WITH REAR DRIVE LINKAGE

[75] Inventor: Raymond Holobaugh, Tupelo, Miss.

[73] Assignee: Mohasco Corporation, Amsterdam, N.Y.

[21] Appl. No.: 916,007

[22] Filed: Jun. 16, 1978

[51] Int. Cl.[2] ..... A47C 1/035

[52] U.S. Cl. ..... 297/85; 297/322

[58] Field of Search ..... 297/83–87, 297/318, 317, 322, 341, 342

[56] References Cited

U.S. PATENT DOCUMENTS

| | | | |
|---|---|---|---|
| Re. 28,210 | 10/1974 | Re' | 297/83 |
| 3,550,952 | 12/1970 | Ferguson | 297/85 |
| 3,572,820 | 3/1971 | Ferguson | 297/84 |
| 3,941,417 | 3/1976 | Re' | 297/85 |
| 3,958,827 | 5/1976 | Ré | 297/322 X |
| 4,077,663 | 3/1978 | Cycowicz et al. | 297/83 |

*Primary Examiner*—William E. Lyddane

*Attorney, Agent, or Firm*—Kirschstein, Kirschstein, Ottinger & Cobrin

[57] ABSTRACT

A wall proximity reclining chair is provided with a rear drive linkage which is located rearwardly of the footrest assembly. The rear drive linkage comprises a train of links in force-transmitting relationship with each other and operatively connected between each movable armrest-mounting member and the stationary base. The rear drive linkage controls movement of the seat and the backrest between the upright, TV and fully reclined positions of the chair.

6 Claims, 4 Drawing Figures

WALL PROXIMITY CHAIR WITH REAR DRIVE LINKAGE

This invention relates to wall proximity chairs, particularly such chairs which are high legged and in which the chair body moves on a track.

An object of this invention is to improve on the chair disclosed in U.S. Pat. No. 3,550,952 and adapt such chair for use as a wall proximity chair.

Another object of this invention is to provide a chair of the character described in which the chair body slides on a stationary track mounted on a floor.

Still another object of this invention is to provide a chair of the character described embodied in a high leg chair.

Yet another object of this invention is to provide a chair of the character described which comprises the following components:

(1) The Base Assembly rests on the floor, is stationary relative to the floor and supports the remainder of the system.

(2) The Track Assembly consists of a stationary member and a member free to move laterally along its length. The stationary member is mounted to the base assembly in an elevated position to facilitate the Hi-Leg appearance.

(3) The Arm Assembly mounts to the free member on the track assembly allowing the arm assembly to move horizontally with respect to the base assembly.

(4) The Mechanism Assembly mounts to the arm assembly and is the control on which all chair actions depend.

(5) The Seat Assembly mounts to the seat support link on the mechanism.

A further object of this invention is to provide a strong, rugged and durable chair and hardware therefor, of the character described, which shall be relatively inexpensive to manufacture, easy to assemble, which shall be smooth in operation and practical and efficient to a high degree in use.

Other objects of this invention will in part be obvious and in part hereinafter pointed out.

The invention accordingly consists of features of construction, combinations of elements, and arrangement of parts which will be exemplified in the construction hereinafter described and of which the scope of invention will be indicated in the following claims.

IN THE DRAWINGS

Figure 1:
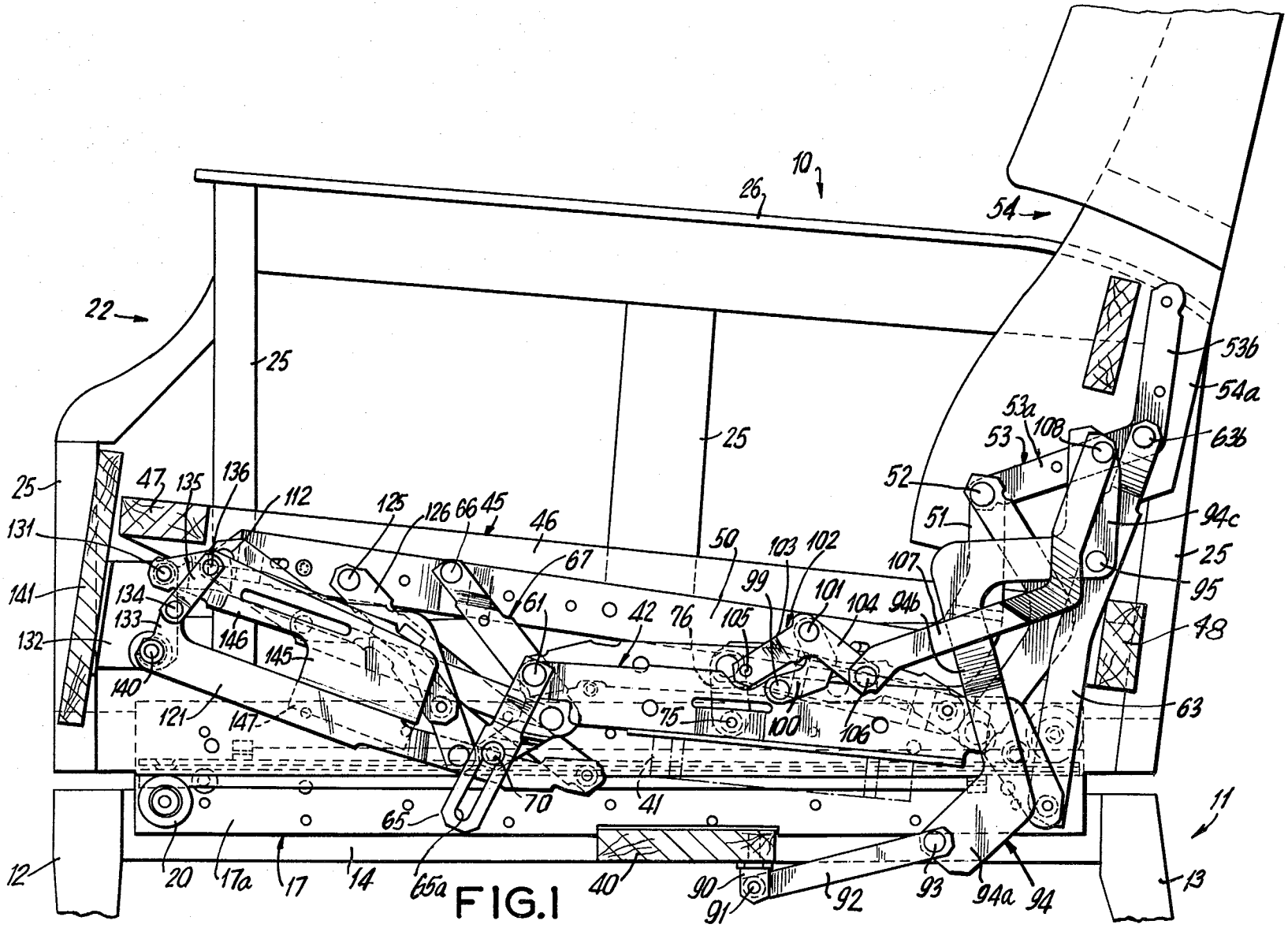
FIG. 1 is a side elevational view of a chair embodying the invention and with parts in cross-section, showing the hardware on one side of the chair in upright position.

Referring now in detail to the drawing, 10 designates a chair embodying the invention. Chair 10 is a recliner wall proximity chair. The chair 10 comprises a base 11 having front legs 12, rear legs 13 and longitudinal rails 14 interconnecting the front and rear legs. This base may be used for a high-legged chair and has front and rear cross-rails 15 connecting the side longitudinal rails 14 (FIG. 4).

Figure 4:
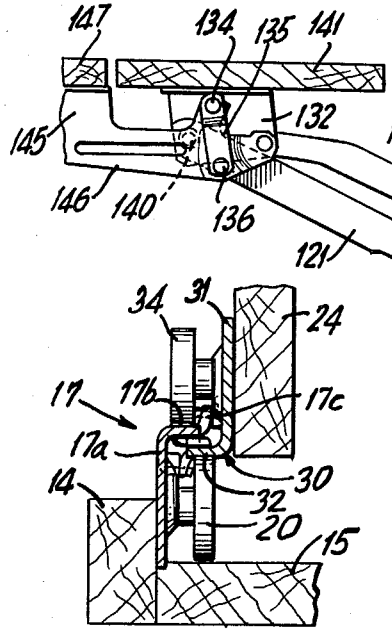
FIG. 4 is a cross-sectional view taken on line 4—4 of FIG. 2.

Fixed to the inner sides of the longitudinal rails 14 are stationary tracks 17 each having a vertical wall 17*a* fastened to the inside of rail 14 and extending thereabove and from which a horizontal web 17*b* projects inwardly and terminating in a short upwardly extending vertical flange 17*c* (FIG. 4).

The flange 17*a* may be fixed to the longitudinal rail 14 by any suitable fastener 18. Mounted on flange 17*a*, adjacent the front end of the stationary track, is a roller or wheel 20 for the purpose hereinafter appearing.

Since the hardware at the right and left sides of the chair are similar and symmetrically disposed, only the hardware on the right side of the chair is shown and will be described herein.

The chair 10 further comprises a chair body or armrest assembly 22 movably mounted by means of a movable track at its underside, to be described hereinafter, slidable on the stationary track 17 so as to be movable away from or toward a wall at the rear of the chair so that as the chair moves from upright to reclined position, the body will move away from the wall so as not to touch said wall as the chair moves to reclined position.

The chair body 22 comprises right and left side arms 23. Said side arms are similar and symmetrically disposed and comprise side walls 24 in vertical planes. In the upright closed position of the chair the side arms overlie the base 11 so as to substantially cover it.

Said side arms 23 are interconnected by a center cross rail 41 in the usual manner and have vertical uprights 25 and arm support portions 26. Cross rail 41 slants rearwardly and downwardly and supports left and right armrest-mounting members 42 (only the arm mounting member on the right side of the chair being shown). Arm mounting members 42 are like arm mounting members 53 of said U.S. Pat. No. 3,550,952.

Attached to the outer side of the side walls 24 are movable tracks 30. Only the movable track on the right side of the chair will be described. Track 30 comprises a flange 31 in a vertical plane but extending horizontally, fixed to wall 24. Extending outwardly from the lower end of wall 31 is a web 32 in a horizontal plane contacting the top of wheel or roller 20 (FIG. 4).

Rotatably mounted on the outside of flange 31, adjacent the rear end of said flange is a wheel or roller 34 which rests on top of the web 17*b*. Track 31 is fastened to wall 24 by any suitable fasteners 36.

The rails 14 of the base are interconnected by a transverse base assembly cross-rail 40 in a horizontal plane for the purpose hereinafter appearing.

The chair 10 further comprises a seat frame 45 comprising longitudinal side rails 46 interconnected by a transverse front cross rail 47 and a transverse rear cross rail 48.

Fixed to the inside of each of the longitudinal rails 46, is a seat-mounting member or link 50 which terminates short of the seat frame front cross rail 47. Extending up from rear end of the seat link 50 is an upstanding arm 51 to the upper end of which is pivoted, as at 52, one end of a backrest-mounting member or back support link 53 to which the chair back 54 is fixed. Link 53 has an arm 53*a* from which another arm 53*b* extends rearwardly at an angle. The chair back 54 may comprise side back members 54*a* interconnected by a cross rail 54*b*. The seat 45 and backrest 54 constitute body-supporting means.

The arm mounting member 42 has an ear 60 (FIG. 3) at its front end carrying a pivot pin 61. At the rear end of the arm mounting member 42 is a downwardly and rearwardly slanting arm 42*a*. A rear control link 63 is pivoted at its lower end by pivot 64 to the lower end of arm 42*a*, and its upper end is pivoted, as at 63*b* to the junction of arms 53*a*, 53*b* of the back support link 53 and is similar to the rear control link 81*a* of said U.S. Pat. No. 3,550,952.

Pivoted to the pivot pin 61 is a sequencing link 65, formed with a longitudinal slot 65*a* at its outer end.

Pivoted to the seat link 50 as at 66 is a leg rest and sequencing control bell crank link 67 which has an arm 68 extending from its pivot 66. Extending from the lower end of arm 68, forwardly is an arm 69 carrying a pin 70 at its outer end slidably received in slot 65*a* of the sequencing link 65.

In the upright position of the chair, the slotted sequencing link 65 projects down from pivot 61 and the pin 70 is at the upper end of slot 65*a*. In such position the seat cannot be raised because of the contact of pin 70 at upper end of slot 65*a*, whereby the chair must go to the T.V. position of FIG. 2 before the chair can go to fully reclined position. As the chair goes from upright to T.V. position, the sequencing link swings in a clockwise direction to bring the sequencing link to horizontal position from which position the chair can be moved to fully reclined position as the sequencing link continues to swing in a clockwise direction.

Figure 3:
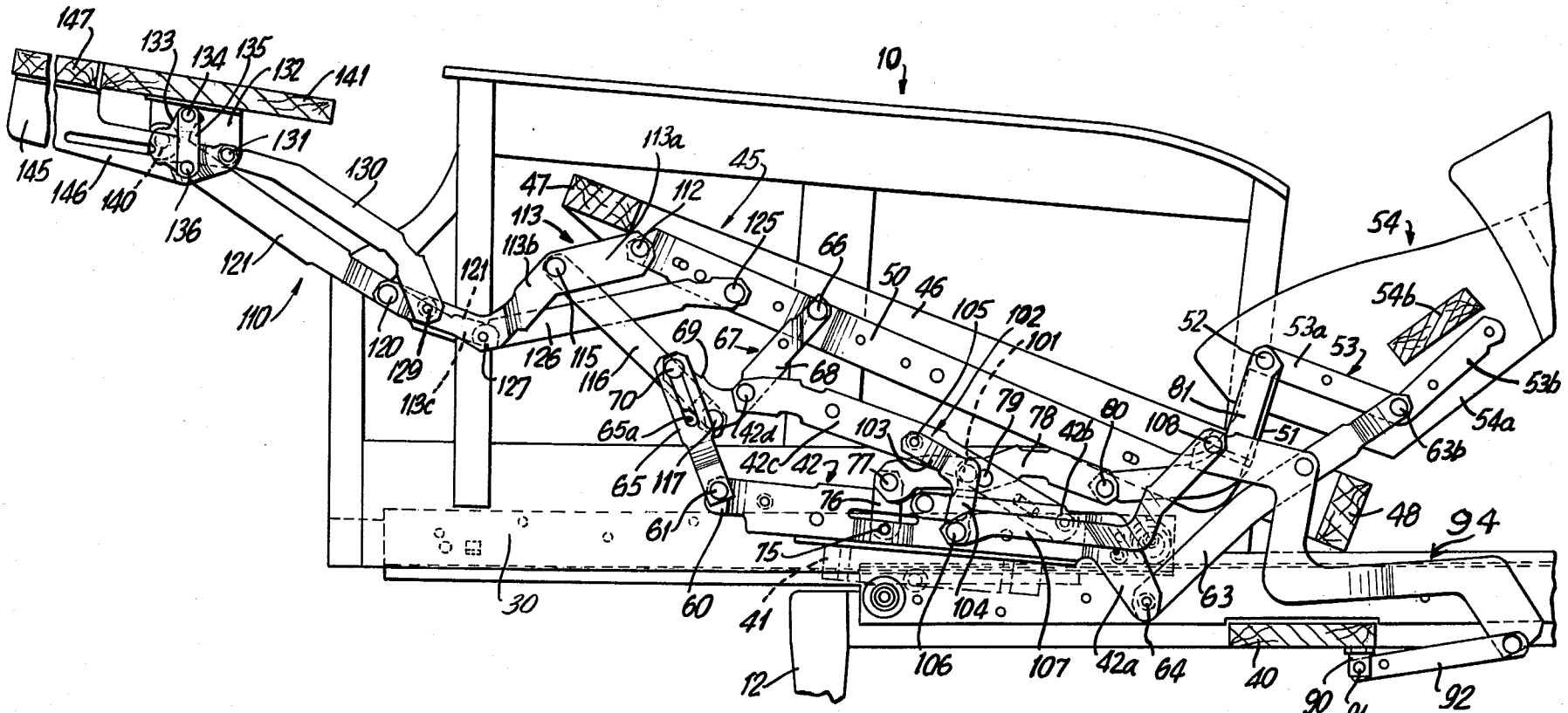
FIG. 3 shows the chair in fully reclined position.

As best shown in FIG. 3, pivoted to the arm mounting member 42 as at 42*b* is a primary lifter link 42*c* pivoted as at 42*d* to arm 68 of bell crank 67 near the junction of arms 68, 69. Pivoted to the arm mounting member 42 as at 75 is a short anchor link 76. The upper end of link 76 is pivoted as at 77 to a secondary lifter link 78. The primary lifter link 42*c* crosses the secondary lifter link 78 and said links are interpivoted where they cross, by a pivot pin 79. The rear end of the secondary lifter link 78 is pivoted as at 80 to the front end of a rear carrier link 81, the upper end of which is pivoted to the pivot pin 52 by which the rear of the seat link is pivoted to the back support link. The primary and secondary lifter links 42*c* and 78 constitute lifter means. Up to this point the linkage described is identical in function to the corresponding linkage disclosed in said U.S. Pat. No. 3,550,952. The linkage heretofore described which kinematically connects the seat-mounting members 50 and backrest-mounting members 53 to the armrest-mounting members 42 comprises body support-to-armrest linkage means (e.g. 65, 67, 42*c*, 78, 76, 81, 63). The chair shown in said patent however is not a wall proximity chair, as is the chair disclosed herein.

To this end, a base attachment bracket 90 is fixed to the rear underside of the cross rail 40. Pivoted to said bracket, as at 91, is a long support link 92 which extends rearwardly and slants somewhat upwardly in the upright position of the chair. Pivoted to the rear end of long support link 92, as at 93, is the lower end of a drive link 94. In the upright position of the chair (FIG. 1), said drive link comprises a lower portion 94*a* slanting upwardly and rearwardly. Extending from the upper end of portion 94*a* is a portion 94*b* which slants upwardly and forwardly. Extending from the upper end of portion 94*b* is an upper end portion 94*c* which projects almost vertically. At the junction of portions 94*b*, 94*c* is a pivot pin 95 pivotally connecting the drive link 94 to rear control link 63.

Pivoted to the arm mounting member 42 as at 99, just rearwardly of anchor link 76 is one end of a bent pivot link 100. The other end of said pivot link 100 is pivoted as at 101 to the midpoint of a bell crank 102. Said bell crank 102 has arms 103, 104 in relative angular positions. The outer end of arm 103 is pivoted at 105 to the primary lifter link 42*c* at a point between pivot pins 79 and 42*d*. Pivoted to the other arm 104 of the bell crank 102, as at 106 is one end of a drive control link 107. The other end of the drive control link 107 is pivoted as at 108, to the upper end of portion 94*c* of drive link 94.

This chair is provided with leg rest mechanism or footrest assembly 110 which is similar in function to the leg rest mechanism of U.S. Pat. No. 3,550,952. To this end there is pivoted to the seat link 50 as at 112, located at the front end of the seat link, a link 113. In the fully reclined position of the chair, said link 113 has an upper portion 113*a* inclined forwardly and downwardly. Extending from portion 113*a* is a portion 113*b* which inclines forwardly and downwardly, but at a greater angle than portion 113*a*. Extending from portion 113*b* is a portion 113*c* which projects forwardly and slightly slants upwardly. Pivoted to the junction of portions 113*a*, 113*b*, as at 115, is a link 116 which inclines rearwardly and downwardly and is pivoted, as at 117 to bell crank 67 at the junction of arms 68 and 69 of said bell crank. At the outer end of portion 113*c* of link 113 is a pivot pin 120. Pivoted at an intermediate portion thereof, to pin 120 is a link 121. Pivoted to the seat link 50, rearwardly of pivot 112, as at 125, is a link 126 pivoted at its front end by pivot 127 to the rear end of link 121. Pivoted to portion 113*c* of link 113, as at 129 is the rear end of link 130. Link 130 is pivoted as at 131 to a legrest bracket 132.

Link 121 has an offset finger 133 at one end. Finger 133 carries a pivot 134 to which is pivoted a link 135 which is pivoted to a second bracket 145, as at 136. Link 121 is pivoted to bracket 132 as at 140. Bracket 132 carries an ottoman part 141.

The second legrest bracket 145 has an arm 146 pivoted to the pivot 131, and carries an ottoman part 147. The leg rest construction described herein is well known and is not specifically part of this invention. Other legrest constructions can be substituted. This legrest is shown and described in U.S. Pat. No. 3,550,952.

Figure 2:
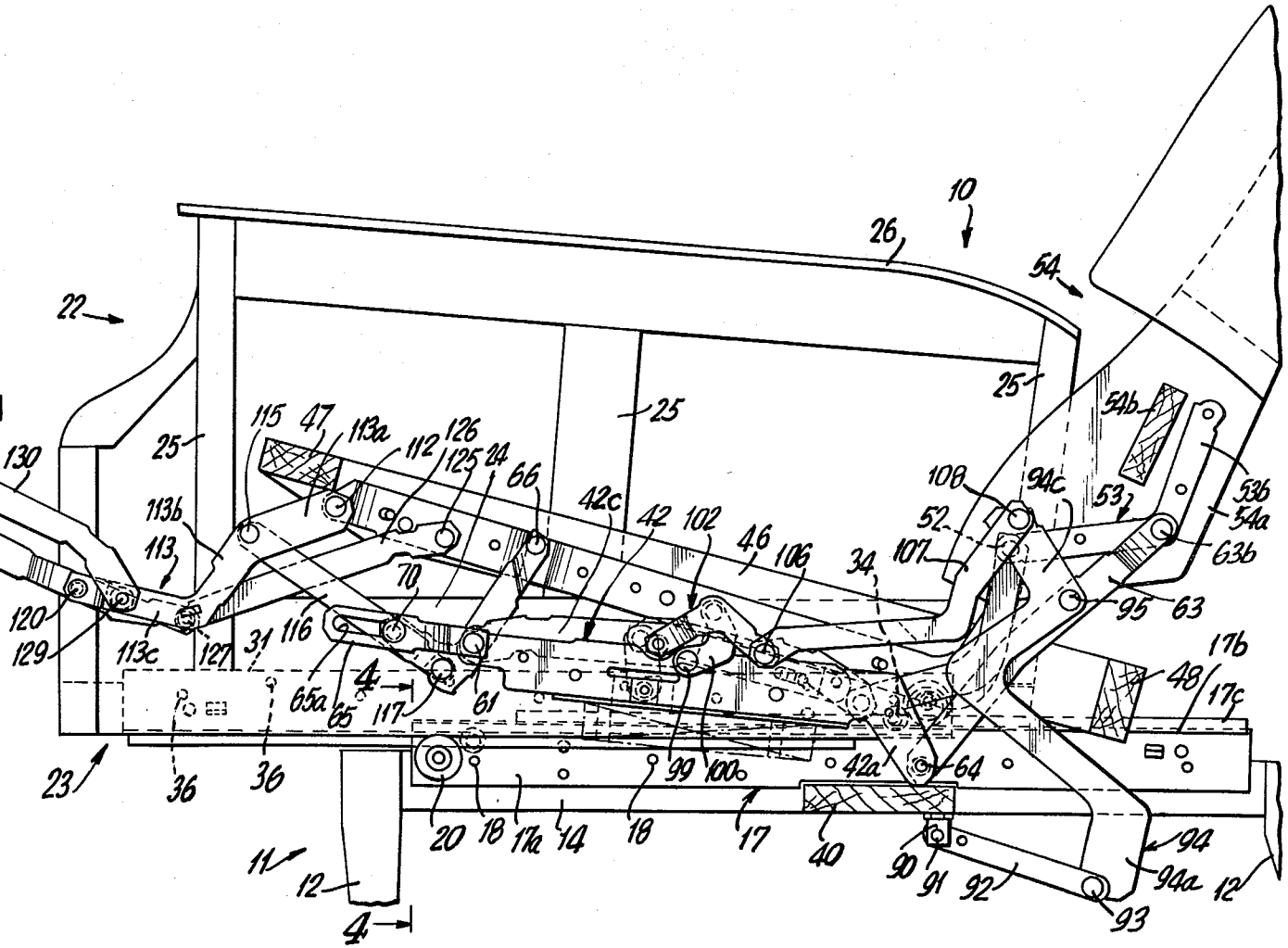
FIG. 2 shows the chair of FIG. 1 in T.V. position.

In the T.V. and fully reclined positions of the chair, legrest parts 141, 147 are in substantial alignment next to each other as shown in FIGS. 2 and 3 and together constitute the ottoman or legrest for the occupant of the chair. In the upright position of the chair, legrest part 141 is almost vertical at the front of the chair. The legrest linkage is located behind the legrest part 141 and below the front part of the seat frame 45, whereas the legrest part 145 is located beneath the seat frame as shown in FIG. 1.

The base attachment bracket 90 is stationary and serves as a pivotal point against which the horizontal motion of the side arms is initiated and controlled. The long support link 92 is an idler link to allow for vertical rotational displacement of the drive link 94 and to facilitate placement of the base attachment bracket. The drive link 94 functions as a bellcrank rotating relative to rear control link 63 with the long support link 92 being the driven part and control link 107 the driver.

The control link 107 determines the amount of rotation imparted to the drive link 94 relative to the rear control link 63 in the first portion of the mechanism cycle (closed to T.V. positions) and is a transmission link between the bell crank 102 and the drive link 94 in the second portion of the mechanism cycle (T.V. to fully reclined positions).

The bell crank 102 is stationary in the first portion of the mechanism cycle (closed to T.V.) and provides a stationary pivot relative to the side arm of the chair body, at its connection to the control link 107 through which, by its connection to the drive link 94, restrains the drive link 94 for that portion of the mechanism cycle, causes a rotational motion of the drive link 94, through the long support link 92 and the base attachment bracket 90, is transmitted as a linear motion, resulting in a proportional relative horizontal motion between the side arm and the base.

In the second portion of the mechanism cycle (T.V. to fully recline) the bell crank 102, by rotation of the back relative to the seat which imparts a rotation in lifter link 42*c*, is caused to rotate about pivot link 100 and through the control link 107 causes a further rotation of the drive link 94 relative to rear control link 63 which through the long support link 92 and the base attachment bracket 90 is transmitted as a linear motion, resulting in an additional proportional relative horizontal motion between the side arm and base, completing the wall proximity function.

The pivot link 100 serves as a floating pivot about which the bell crank 102 rotates making that rotation of such a proportion as to be appropriate for the sequence relative motion between the side arm and base.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

I claim:

1. In a wall-proximity reclining chair of the type having (A) a stationary base for supporting the chair on a floor;

(B) body-supporting means including a seat located generally above the base, and a backrest located generally rearwardly of the seat, said body-supporting means having a pair of seat-mounting members each located at an opposite side of the seat, and a pair of backrest-mounting members each located at an opposite side of the backrest;

(C) a movable armrest assembly mounted for longitudinal horizontal reciprocating movement relative to the base, including a pair of armrests each located at an opposite side of the seat, and a pair of interconnected armrest-mounting members each mounted on a respective armrest for moving the armrest assembly forwardly and rearwardly as a unit relative to the base in response to manual urging on the armrest assembly by a seated user;

(D) body support-to-armrest linkage means kinematically connecting the seat-mounting members and backrest-mounting members to the armrest-mounting members, for moving the body-supporting means from an end-limiting upright position in which the seat and backrest are spaced a predetermined distance away from a room wall behind the chair, to an intermediate TV position, and thereupon to an end-limiting fully reclined position in which the seat and backrest are forwardly spaced at a greater distance from the room wall such that physical contact of the body-supporting means with the room wall is avoided in all of said positions, said body support-to-armrest linkage means including lifter means kinematically connected to the front portion of each seat-mounting member and operative for changing the orientation of the seat relative to the base by moving the front portions of the seat-mounting members in a generally vertical direction; and (E) a footrest assembly operatively connected to said body support-to-armrest linkage means at the front of the chair, for successively extending a footrest forwardly and upwardly of the base when the body-supporting means moves from its upright towards its fully reclined position;

the improvement comprising:

rear drive linkage means operatively connecting the body support-to-armrest linkage means to the base along a force-transmitting path which extends rearwardly of the footrest assembly, and operative for controlledly driving the body support-to-armrest linkage means to thereby effect movement of the body-supporting means between its positions, said rear drive linkage means including at opposite sides of the seat (a) a bent pivot link having one end pivotally connected to the armrest-mounting member, and an opposite end;

(b) a bell crank link having one arm pivotally connected to the lifter means, another arm having a drive pivot point, and an intermediate portion pivotally connected to the opposite end of the bent pivot link;

(c) a drive control link having one end pivotally connected at said drive pivot point of the bell crank link and an opposite end;

(d) a drive link having one arm pivotally connected to the opposite end of the drive control link, another arm having a driven pivot point, and an intermediate portion pivotally connected to the body support-to-armrest linkage means;

(e) an idler link having one end pivotally connected at the driven pivot point of the drive link, and an opposite end pivotally connected to the base; and (f) said links together constituting a linkage train which kinematically connects each movable armrest-mounting member to the stationary base, for transmitting forces along the train during movement of the body-supporting means between said positions.

2. The improved chair as defined in claim 1, wherein said base includes front and rear legs for supporting the body-supporting means at a raised elevation relative to the floor, and a base cross rail intermediate the front and rear legs; and wherein the rear drive linkage means is connected to the base at the base cross rail.

3. The improved chair as defined in claim 2; and further comprising a bracket mounted on the base cross rail, and wherein said opposite end of the idler link is pivotally connected to the bracket.

4. The improved chair as defined in claim 2, and wherein a portion of the idler link is located below the base cross rail and above the floor.

5. The improved chair as defined in claim 1; and further comprising stationary track means mounted on the base, movable track means mounted on the armrest assembly, and means intermediate the stationary track means and the movable track means for permitting the latter to be moved relative to the former.

6. The improved chair as defined in claim 1, wherein said lifter means includes a primary lifter link having one end pivotally connected to the rear region of the armrest-mounting member, and another end operatively connected to the front portion of the seat; and a secondary lifter link having one end operatively connected to the front region of the armrest-mounting member, and another end operatively connected to the rear portion of the seat; and wherein said primary and secondary lifter links cross and are pivotally connected with each other in an intermediate region between their respective ends.

* * * * *